US007793738B2

(12) United States Patent
Frederick

(10) Patent No.: US 7,793,738 B2
(45) Date of Patent: Sep. 14, 2010

(54) MODIFIED BOX SCRAPER SYSTEM AND APPARATUS

(76) Inventor: Michael Frederick, P.O. Box 546, Atascadero, CA (US) 93423

( * ) Notice: Subject to any disclaimer, the term of this patent is extended or adjusted under 35 U.S.C. 154(b) by 928 days.

(21) Appl. No.: 11/506,043

(22) Filed: Aug. 16, 2006

(65) Prior Publication Data

US 2008/0053674 A1 Mar. 6, 2008

(51) Int. Cl.
*E02F 3/64* (2006.01)

(52) U.S. Cl. ..... 172/684.5; 172/253

(58) Field of Classification Search ..... 172/777, 172/778, 799.5, 245, 250, 251, 252, 253, 172/445.1, 684.5
See application file for complete search history.

(56) References Cited

U.S. PATENT DOCUMENTS 2,051,283 A * 8/1936 Austin ..... 172/799.5
2,880,528 A * 4/1959 Lusk ..... 172/780
4,815,542 A * 3/1989 DePlazes ..... 172/253
4,869,326 A * 9/1989 Hutchins et al. ..... 172/197
5,172,499 A * 12/1992 Griffin ..... 37/407
5,806,605 A * 9/1998 Keigley ..... 172/145
5,833,012 A * 11/1998 Pierce et al. ..... 172/199
6,360,827 B1 * 3/2002 Clary ..... 172/799.5
6,467,552 B1 * 10/2002 Whatmough ..... 172/445.1
6,845,824 B2 * 1/2005 Miskin ..... 172/684.5
7,017,502 B2 * 3/2006 Quam et al. ..... 111/174
RE39,889 E * 10/2007 Keigley ..... 172/145
7,600,575 B2 * 10/2009 Fredrick ..... 172/684.5

* cited by examiner

*Primary Examiner*—Thomas B Will
*Assistant Examiner*—Joel F Mitchell
(74) *Attorney, Agent, or Firm*—Sandy Lipkin

(57) ABSTRACT

A modified box scraper system that is fitted with a first, second and third plurality of attachment devices located on the rearward end and both sides of the box scraper allowing for the attachment of a variety of modified work implements, the modified work implements including box scraper extensions, a road repair fabric applicator, a trench compaction wheel, a slope board, a rear forklift system, a windrow scraper, a backfill blade and a serrated cutting blade.

2 Claims, 6 Drawing Sheets

MODIFIED BOX SCRAPER SYSTEM AND APPARATUS

BACKGROUND OF THE INVENTION

1. Field of the Invention

The present invention relates generally to the field of box scrapers commonly used behind tractors.

2. Description of the Prior Art

During construction, paving, grading and the like, typically in order to be prepared for the work to be done at a given site, contractors have had to move several pieces of grading equipment to the job site. One general piece of equipment is a tractor. Tractors commonly have box scrapers attached thereto.

Box scrapers are well-known in the art of construction, paving and other earth-moving activities. Box scrapers are attached to the back of a tractor and are height adjustable. A hydraulic system is typically in place that allows the box scraper to move in a vertical direction. Traditional box scrapers typically form a small, finite number of functions.

In addition to the box scraper, tractors have a front bucket that carries loads. Generally modifications have been made to the front bucket in the past in order to enable the tractor to perform more than one function. Modifications to buckets are known in the art, but are limited to a relatively few number of versatile operations. Some modifications have been made to box scrapers as well, but suffer from the same limitation as the front bucket with regard to the number of operations that can be performed.

By providing a system wherein some or all of the equipment needed for construction, paving, grading and the like can be utilized quickly and efficiently, contractors can save money on equipment, manpower, equipment moving costs and time. The instant invention seeks to provide such a system by innovatively modifying existing box scrapers to activate innovative grading implements that have been modified for use with the modified box scraper itself.

SUMMARY OF THE INVENTION

The preferred embodiment of the present invention teaches a method and apparatus that provides for improved functionality and flexibility of a tractor. This method involves first the attachment of a modified box scraper apparatus on the back of a tractor through connection of the box scraper to a hydraulic system found on the tractor that allows for vertical movement of the box scraper. The box scraper is comprised of a main frame having a rearward end, a first side and a second side. The rearward end contains a first plurality of attachment means. The first side contains a second plurality of attachment means, and the second side contains a third set of attachment means. One of a variety of modified work implements are then attached to one or more of the attachment means.

The first plurality of attachment means is typically arrayed in a linear formation across the rearward end of the box scraper. The first plurality of attachment means is typically made up of female fittings designed to releasably accept male fittings found on the modified work implements. The second and third plurality of attachment means are also female fittings designed to releasably accept male fittings found on the modified work implements. Typically, these second and third plurality of attachment means are located on one or more locations on the first and second sides of the box scraper, around the perimeters of each side.

The first, second and third pluralities of attachment means also contain solid rubber block inserts that are placed therein to protect the female attachment means from being clogged with dirt, clay, mud, asphalt and other contaminants.

One modified work implement involves the attachment of two side extensions that extend the path for grading beyond the width of the box scraper alone. By adding a half yard of material to the loader buckets on the front of the tractor, better traction and stability can be achieved to accommodate these extenders. Finish grading, subgrade and/or base materials on larger areas can be accomplished more efficiently, saving time.

The extenders each have a main frame that is substantially the same in profile as the box scraper. The box scraper extensions have a rearward end, a connectible side containing releasable male attachment means and an opposing non-connectible side wherein the releasable box scraper extensions are attached to the box scraper through male attachment means located on the connectible sides of the box scraper extensions. The second and third plurality of attachment means found on the first side and second side of the box scraper utilizes releasable male attachment means that connect the box scraper extensions to the box scraper.

Another modified work implement involves the attachment of a road repair applicator, such as PETROMAT®. By loading up to one mile of fabric on the loader bucket of a tractor, the contractor is independent of the need for a supply vehicle.

The road repair applicator is comprised of a first elongated member containing a geotextile such as PETROMAT®. The first elongated member contains rests on two fittings found on two additional elongated members located on either side of the first elongated member. These two additional members attach to the first and second sides of the box scraper through male attachment means attached to one of the female attachment means found on the first and second sides of the box scraper.

A second elongated member containing a plurality of bristles is releasably attached to the rearward end of the box scraper through a third elongated member that is attached to the second elongated member in a position substantially in the center of the second elongated member and substantially perpendicular thereto. The third elongated member releasably attaches to one of the first plurality of attachment means found on the rearward end of the box scraper.

The second elongated member is designed to give a broom finish to the laid fabric. This saves on the costs of sub-contracting the installation, which saves money to the contractor.

Yet another modified work implement is a trench compaction wheel. Laying underground utilities in a narrow trench involves the difficulty of making compaction. In the past, differential settlement has been a problem. With the addition of this compaction wheel on the modified box scraper, this problem is alleviated when used with optimum moisture conditions.

A trench compaction wheel can be attached to the modified box scraper. The trench compaction wheel further comprises an axle portion. The axle portion is attached to a first elongated member that is positioned in a substantially vertical position. There is a male attachment means for releasable attachment to one of the first plurality of attachment means on the box scraper. The male attachment means is connected to a sleeve that surrounds the vertical elongated member and contains a securing means to releasably attach to the vertical elongated member.

The trench compaction wheel is further comprised of one or more substantially circular members containing a plurality of teeth that turn in a circular direction when pressure is exerted on the axle portion.

Yet another modified work implement consists of a slope board. The slope board is preferably made of solid steel, thereby adding strength and durability. The operator of the tractor can control the degree of slope by using the hydraulic tilt of the box scraper.

The slope board is composed of a substantially rectangular shaped main body portion that has a front concave side, a back convex side, a top edge, an internal side edge, an external side edge and a bottom edge. Serrated teeth are located along the bottom edge. One or more male attachment means are attached to the back convex side edge of the slope board, thereby attaching the slope board to either the first side or the second side of the box scraper at a prescribed angle in order to provide the ability to cut a slope grade in an earthen bank.

Yet another modified work implement is a rear forklift system. With this system, one can attach forks to the rear of the tractor, dramatically improving visibility and safety. Furthermore, time is saved during the movement of loads. Another additional benefit to the rear fork system is that loads can traverse uneven terrain while maintaining a level load.

The rear forklift system is comprised of a plurality of hooks that attach to the first plurality of attachments located on the rearward end of the box scraper. There exists an elongated member that is held in place by the plurality of hooks.

Additionally, there are two fork members, each having a vertical portion and a horizontal portion. The vertical portion is positioned perpendicular to the horizontal portion. There is an attachment means positioned near the top of the vertical portions of the fork members that allow for attachment of the fork members to the elongated member. Also integral is a securing means, such as a pin, to secure the plurality of hooks attached to the first plurality of attachment means in place.

Yet another modified work implement is a windrow scraper. After achieving base grade, the windrow scraper is a necessary implement that creates a windrow or choker for the backfill of asphalt, chip seal or concrete. On smaller jobs, such as driveways, the windrow scraper alleviates the extra cost of a road grader and transportation.

The windrow scraper is comprised of a main frame that is a hollow, box-shaped body with a front side, a back side, a top side, a bottom side, a connectible side, an opposing non-connectible side, and one or more male attachment means attached to the windrow scraper on the connectible side attaching the windrow scraper to either the first side or the second side of the box scraper at a prescribed angle in order to provide a windrow of material along the edge of the road as the box scraper and the tractor grade a road surface.

Yet another modified work implement is a backfill blade. After the completion of paving or chip seal, the choker or windrow is graded with the backfill blade, thereby eliminating shovelers and rakers for the finished product. The use of a road grader on newly laid asphalt or chip seal may cause damage to these finish materials in warmer climates. By using the backfill blade with the modified box scraper, damage is less likely to occur, if at all.

The backfill blade is composed of a substantially rectangular shaped main body portion that has a front concave side, a back convex side, a top edge, a connectible side edge, an opposing non-connectible side edge and a bottom edge. The bottom edge can be either smooth or serrated.

There exists one or more male attachment means attached to the backfill blade on the connectible side edge attaching the backfill blade to either the first side or the second side of the box scraper.

Yet another modified work implement is a serrated cutting blade. The serrated cutting blade is comprised of a main body portion that is substantially planar having a front face, a back face, a top portion, a first side portion, a second side portion and a bottom portion. The bottom portion has a serrated edge. There is a plurality of attachment means attached to the front face of the main body portion that has releasable male attachment upper ends that attach to the first plurality of attachment means on the rearward end of the box scraper.

A first side attachment means is located on the fist side of the main body portion bends at a right angle and attaches to the second plurality of attachment means located on the first side of said box scraper. The second side attachment means located on the second side of the main body portion bends at a right angle and attaches to the third plurality of attachment means located on the second side of the box scraper.

Yet another modified work implement is a gutter blade. Before a roadway or paving job is complete a gutter needs to be cut at the edge of the roadway to allow rain to drain away from the road, thus protecting the integrity of the road. In the past a road grader was used for this operation, requiring extra time, manpower, operators, trailers and equipment. Through the use of the gutter blade and the modified box scraper, the need for these extras is eliminated.

The gutter blade has a substantially rectangular shaped main body portion that has a front concave side, a back convex side, a top edge, a connectible side edge, an opposing non-connectible side edge and a bottom edge. There is a protruding member that is slightly shorter in length than the main body portion. The protruding member is positioned substantially in the center portion of the convex side of the gutter blade. There are one or more male attachment means attached to the gutter blade on the connectible side edge attaching the gutter blade to either the first side or the second side of the box scraper.

DETAILED DESCRIPTION OF A PREFERRED EMBODIMENT

Figure 1:
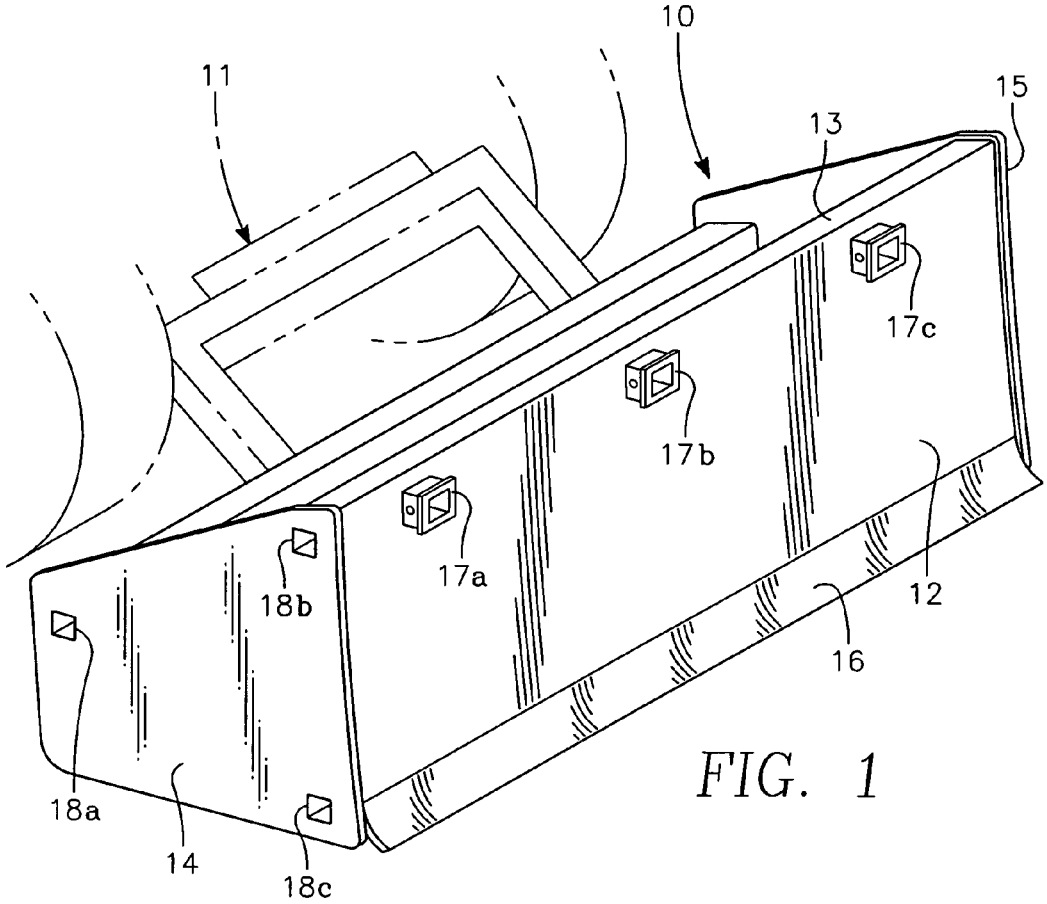
FIG. 1 is an isometric view of the modified box scraper.
Figure 2:
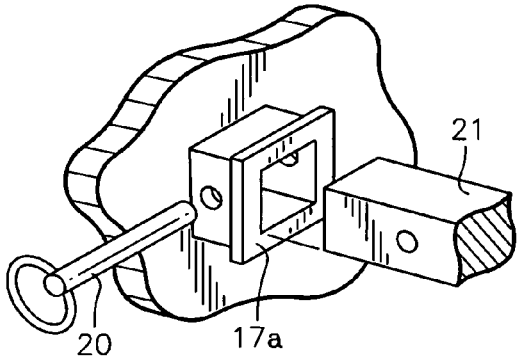
FIG. 2 is a close up view of the female attachment means located on the rearward end of the box scraper.
Figure 3:
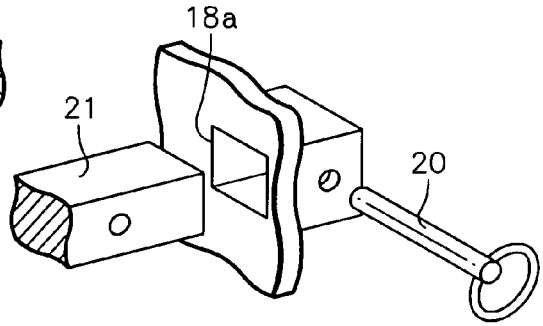
FIG. 3 is a close up view of the female attachment means located on the sides of the box scraper.

Referring now to the drawings. FIGS. 1-3 show the details of the modified box scraper 10 as it attaches the rear of a tractor 11. The box scraper 10 has a main frame 13 consisting of a rearward portion 12, a first side 14 and a second side 15.

The bottom portion 16 of the rearward portion 12 can be beveled, but it is considered within the scope of this invention that the bottom portion 16 could also be flat.

The rearward end 12 of the box scraper 10 has a first plurality of attachment means 17*a*, 17*b*, 17*c*. The first plurality of attachment means 17*a*, 17*b*, 17*c* is typically arrayed in a linear formation across the rearward portion 12 of the box scraper 10 and is typically made up of female fittings that are designed to releasably accept various male fittings found on one or more of the work implements.

A second plurality of attachment means 18*a*, 18*b*, 18*c* are found on the first side 14 of the box scraper 10. A third plurality of attachment means 19*a*, 19*b*, 19*c* are found on the second side 15 of the box scraper 10. The attachable work implements are variously attachable to any of these sets of attachment means 17*a*, 17*b*, 17*c*, 18*a*, 18*b*, 18*c*, 19*a*, 19*b*, 19*c*. A securing means, such as a pin 20 is used to secure the various work implements to the appropriate side of the box scraper 10.

All of the attachment means 17*a*, 17*b*, 17*c*, 18*a*, 18*b*, 18*c*, 19*a*, 19*b*, 19*c* also contain solid rubber block inserts (not shown) that are placed therein to protect the attachment means 17*a*, 17*b*, 17*c*, 18*a*, 18*b*, 18*c*, 19*a*, 19*b*, 19*c* from being clogged with dirt, clay, mud, asphalt and other contaminants. Each attachment means 17*a*, 17*b*, 17*c*, 18*a*, 18*b*, 18*c*, 19*a*, 19*b*, 19*c* is a female member that accepts a corresponding male member 21 from the appropriate work implement.

Figure 4:
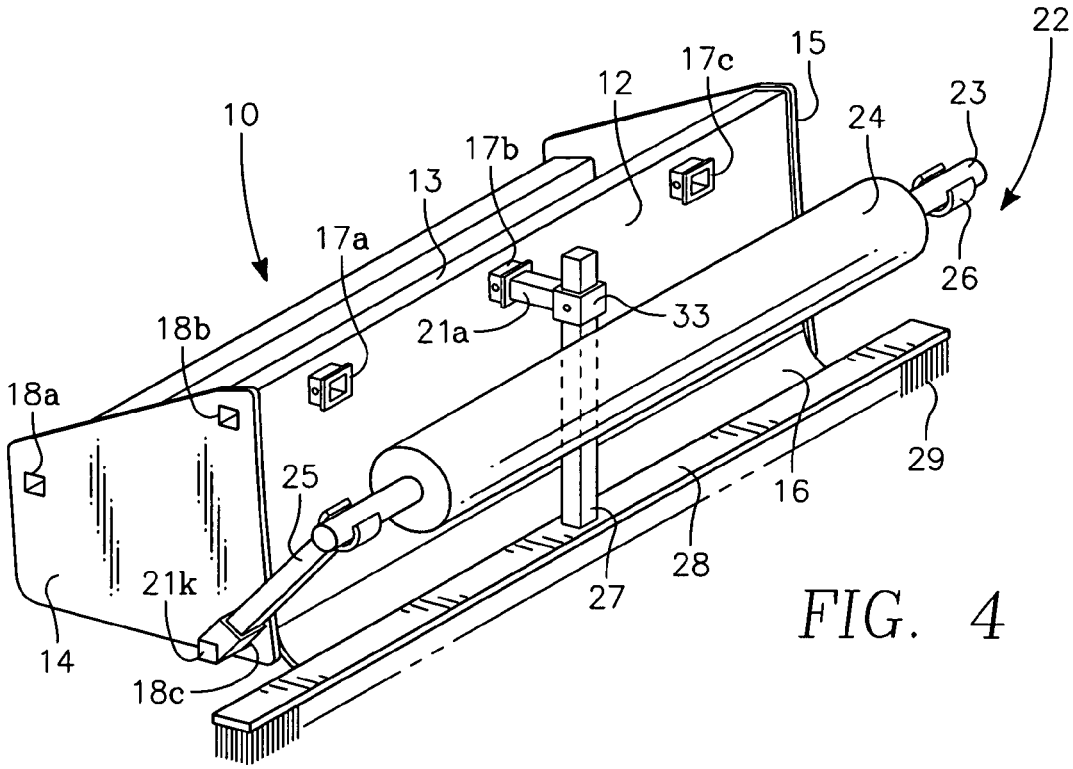
FIG. 4 is an isometric view of the box scraper with the road repair applicator work implement attached thereto.

The road repair applicator work implement 22 attached to the box scraper 10 is shown in FIG. 4. The road repair applicator work implement 22 is composed of a first elongated member 23 containing a roll 24 of geotextile, such as PETROMAT®. The first elongated member 23 is attached to a second member 25 and a third member 26 on either side of the first elongated member 23. Both the second member 25 and the third member 26 have male attachment means 21*k* that attach to one of the second plurality of female attachment means 18*c* and to one of the third plurality of female attachment means 19*c* on the first side 14 of the box scraper 10 and the second side 15 of the box scraper 10, respectively.

A second elongated member 27 positioned substantially in a vertical position attaches to one of the first plurality of female attachment means 17*b* found on the rearward end 12 of the box scraper 10 through a male attachment means 21*a* that is substantially perpendicular to the second elongated member 27 and is attached thereto through a sleeve 33.

A third elongated member 28 is attached substantially perpendicular to the second elongated member 27 at the bottom of the second elongated member 27. A plurality of bristles 29 protrude from the bottom of the third elongated member.

Figure 5:
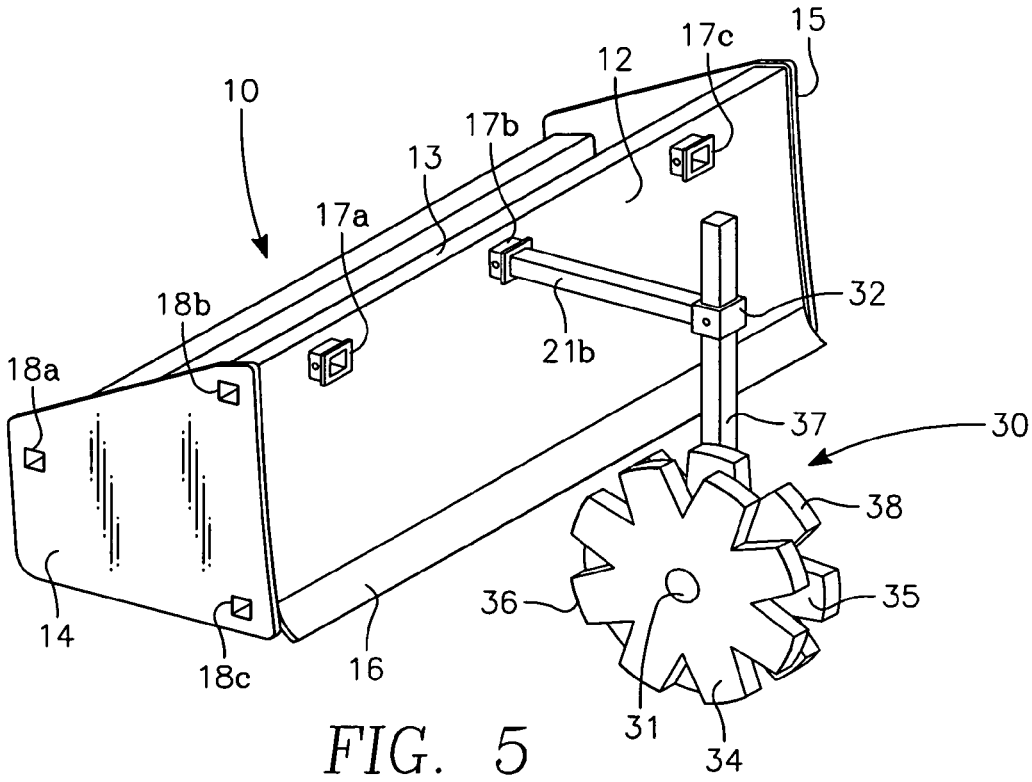
FIG. 5 is an isometric view of the box scraper with the trench compaction work implement attached thereto.

FIG. 5 illustrates the trench compaction wheel 30 work implement. The trench compaction wheel 30 has an axle portion 31 attached to an elongated vertical member 37 that is substantially perpendicular to a male attachment means 21*b* for attachment to the box scraper 10 in one of the female attachment means 17*b* located on the rearward portion 12 of the box scraper 10. The male attachment means 21*b* is connected to a sleeve portion 32 that surrounds the elongated vertical member 37.

The trench compaction wheel 30 has one or more substantially circular members 34, 35 containing a plurality of teeth 36 that turn in a circular direction when pressure is exerted on the axle portion 31 through the exertion of pressure in a direction along the outer edges 38 of the teeth 36.

Figure 6:
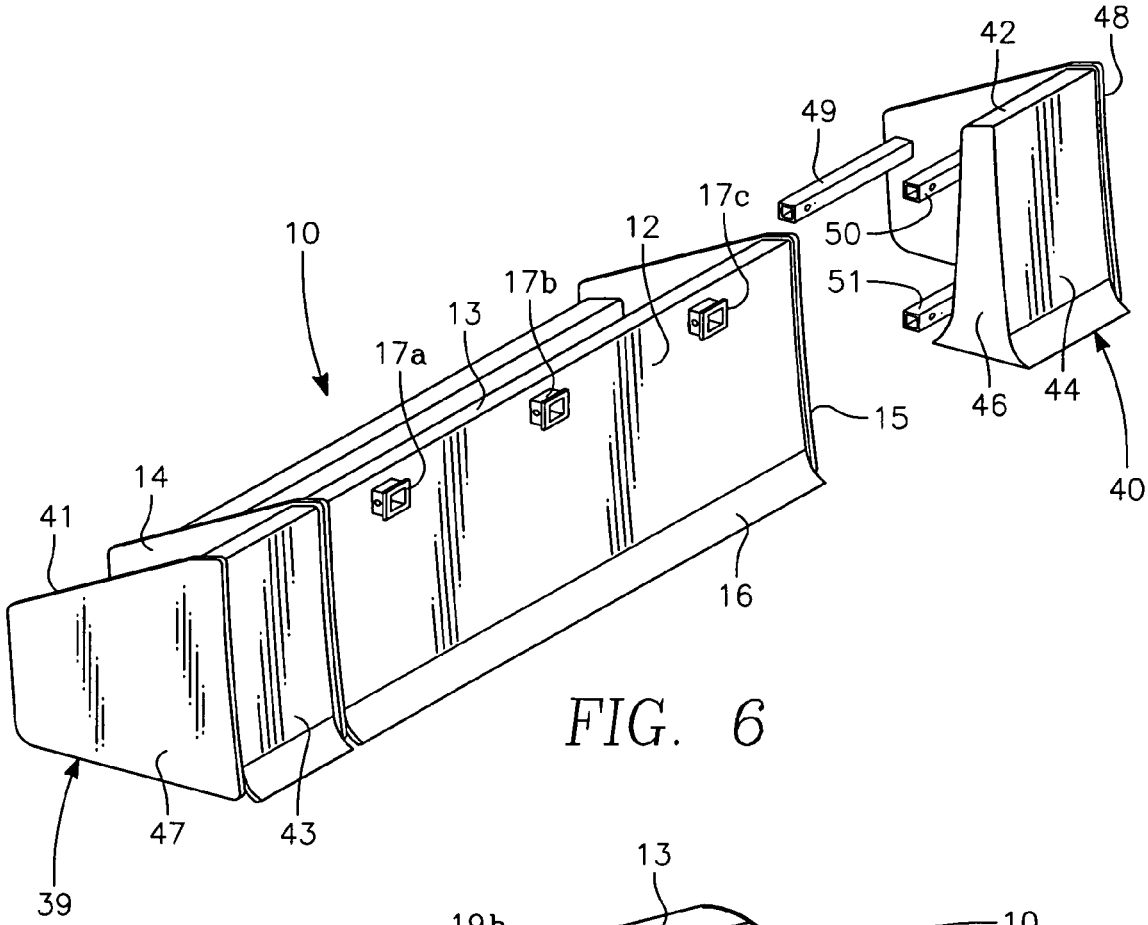
FIG. 6 is an isometric view of the box scraper with the box scraper extension work implements attached thereto.

FIG. 6 illustrates the side extension work implements 39, 40 as they attach to the two sides 14, 15 of the box scraper 10. The extensions 39, 40 each have a main frame, 41, 42 that are substantially the same in profile as the box scraper 10. Each extension 41, 42 has a rearward end 43, 44, a connectible side 45, 46, and an opposing non-connectible side 47, 48. Male attachment means 49, 50, 51 are found on the interior of the connectible sides 45, 46 of the main frames 41, 42 of the extensions 39, 40. The attachment means 49, 50, 51 attach to the female attachment means 18*a*, 18*b*, 18*c*, 19*a*, 19*b*, 19*c* of either side portion 14, 15 of the box scraper 10.

Figure 7:
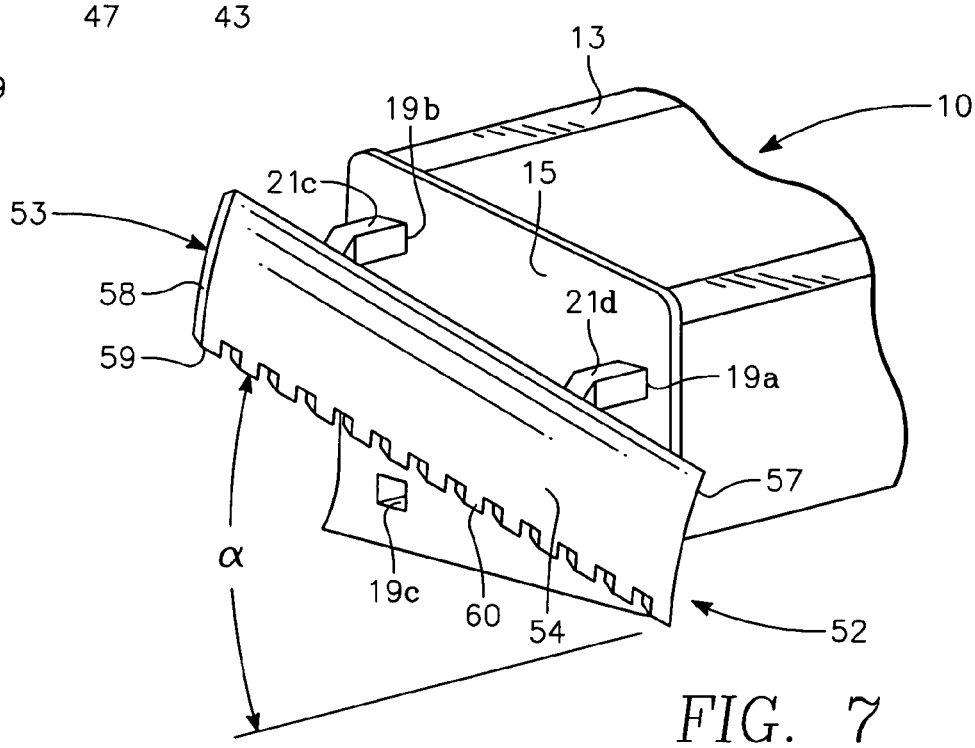
FIG. 7 is an isometric view of the box scraper with the slope board work implement attached thereto.

FIG. 7 illustrates the serrated slope board work implement 52 as it attaches to the second side portion 15 of the box scraper 10. The serrated slope board 52 has a substantially rectangular shaped main body 53 that has a concave side 54, a convex side 55, a top edge 56, an internal side edge 57, an external side edge 58 and a bottom edge 59. Serrated teeth 60 are located along the bottom edge 59. Male attachment means 21*c*, 21*d* are attached to the back convex side 55 of the slope board 52. The slope board 52 attaches to either the first side 14 or the second side 15 portion of the box scraper 10 at a prescribed angle $\alpha$ in order to provide the ability to cut a slope grade in an earthen bank.

Figure 8:
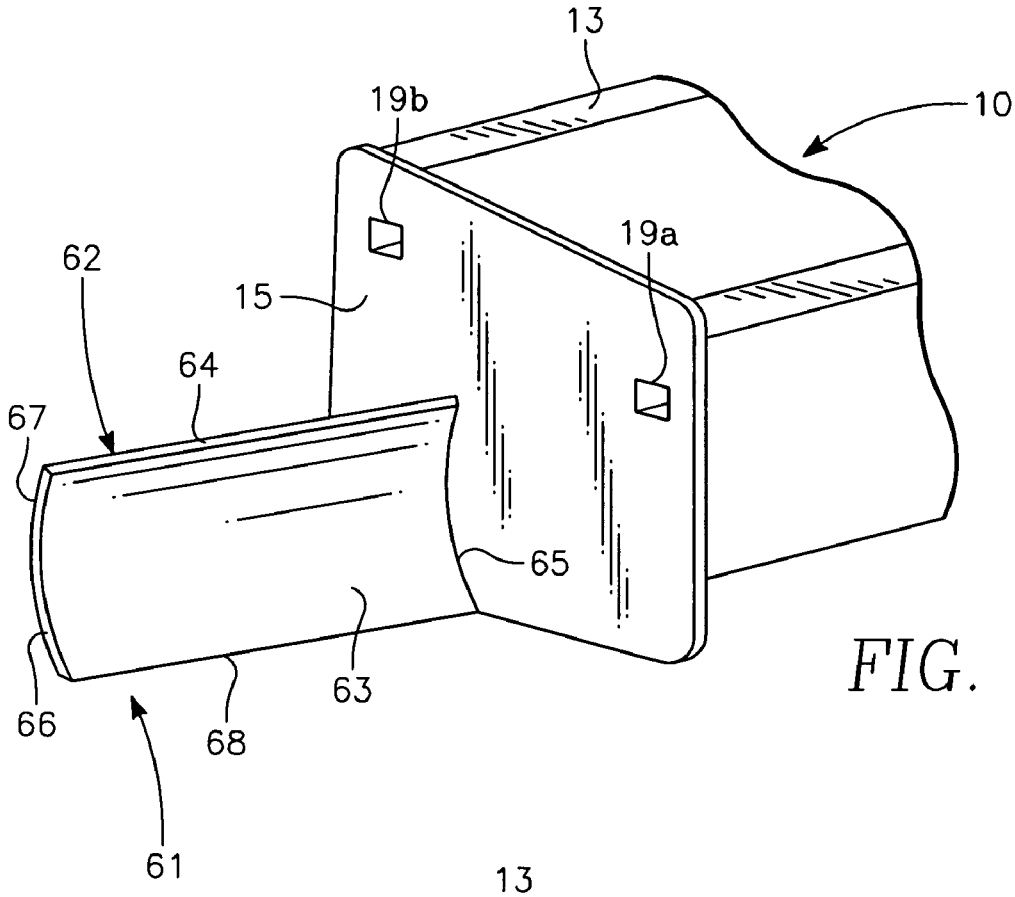
FIG. 8 is an isometric view of the box scraper with the backfill blade work implement attached thereto.

FIG. 8 illustrates the backfill blade work implement 61 as it attaches to the second side portion 15 of the box scraper 10. The main body portion 62 has a front concave side 63, a back convex side 67, a top edge 64, a connectible side edge 65, an opposing non-connectible side edge 66 and a bottom edge 68. The bottom edge 68 can be either smooth (as shown) or serrated. A male attachment means (not shown) attaches the backfill blade 61 on the connectible side edge 65 to either the first side 14 or the second side 15 of the box scraper 10 to one of the female attachment means 19*c*.

Figure 9:
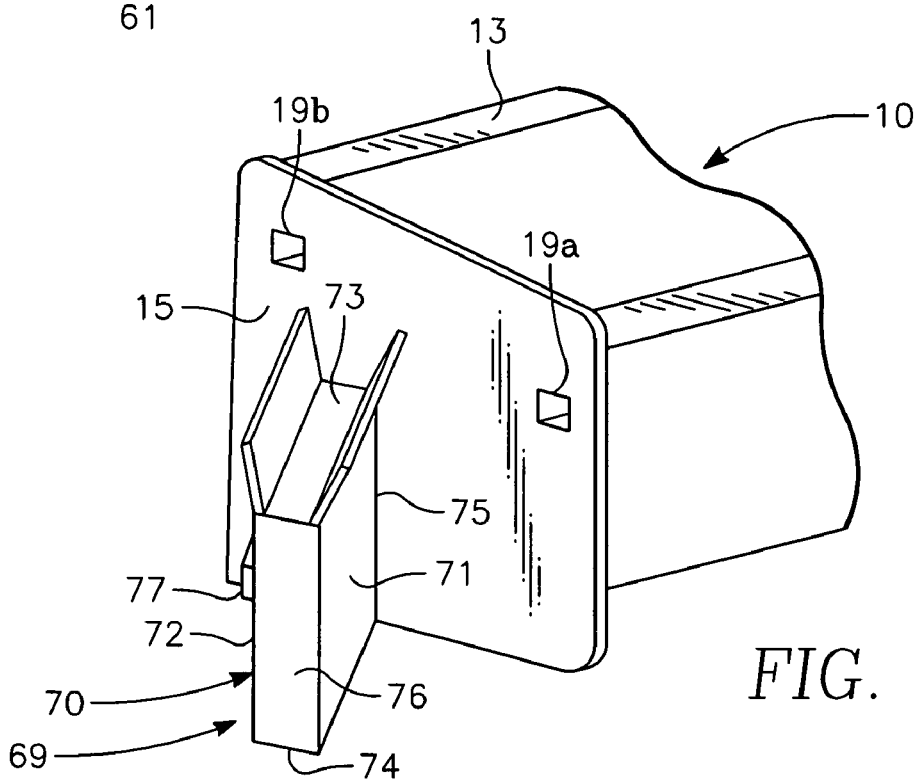
FIG. 9. is an isometric view of the box scraper with the windrow scraper work implement attached thereto.

FIG. 9 illustrates the windrow scraper work implement 69 as it attaches to the second side portion 15 of the box scraper 10. There is a main body 70 that is hollow and box-shaped. The main body 70 has a front side 71, a back side 72, a top side 73, a bottom side 74, a connectible side 75, an opposing non-connectible side 76 and a male attachment means 77 that attaches the windrow scraper 69 on the connectible side 75 to the first side 14 or second side 15 of the box scraper 10 at a prescribed angle in order to provide a windrow material along the edge of the road as the box scraper 10 and the tractor 11 grade road surfaces.

Figure 10:
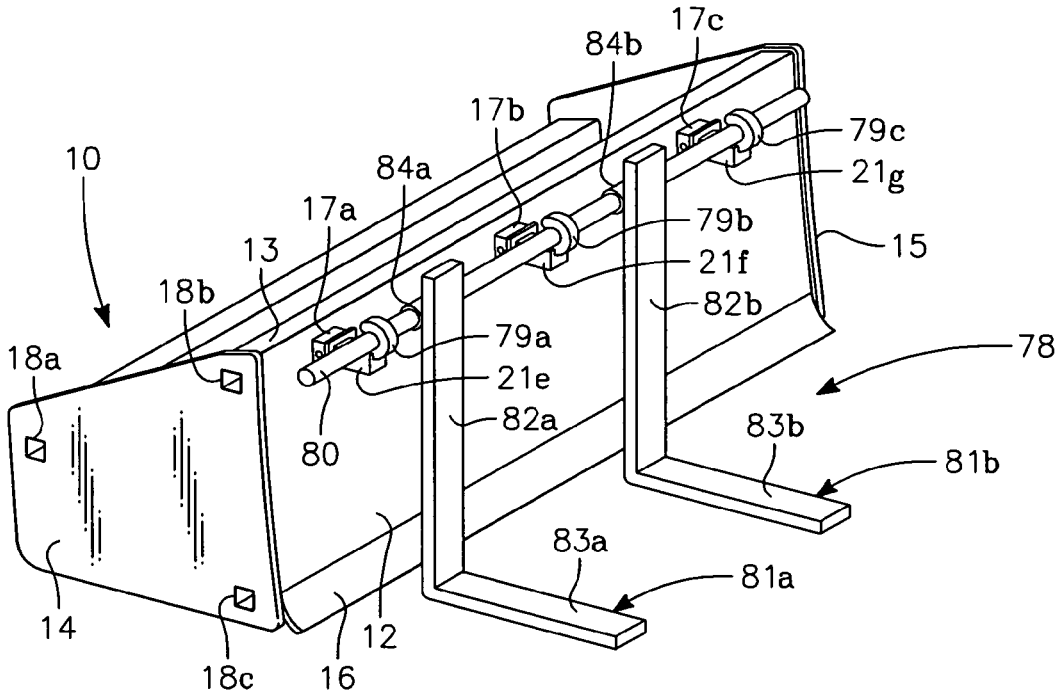
FIG. 10 is an isometric view of the box scraper with the rear forklift system work implement attached thereto.

FIG. 10 illustrates the fork lift work implement 78 as it attaches to the rearward portion 12 of the box scraper 10. There are a plurality of hooks 79*a*, 79*b*, 79*c* that attach the first plurality of attachments 17*a*, 17*b*, 17*c* located on the rearward end 12 of the box scraper 10. There is an elongated member 80 that is held in place by the plurality of hooks 79*a*, 79*b*, 79*c*.

There are two fork members 81*a*, 81*b* having a vertical portion 82*a*, 82*b* and a horizontal portion 83*a*, 83*b*. The vertical portion 82*a*, 82*b* is positioned perpendicular to the horizontal portion 83*a*, 83*b*. There are attachment means 84*a*, 84*b* positioned near the top of the vertical portions 82*a*, 82*b* of the fork members 81*a*, 81*b* that allow for attachment of the fork members 81*a*, 81*b* to the elongated member 80. The plurality of hooks 79*a*, 79*b*, 79*c* are attached to the rearward portion 12 of the box scraper 10 through a plurality of male attachment means 21*e*, 21*f*, 21*g* and secured in place by pins (not shown in FIG. 10 but illustrated in FIGS. 2 and 3 as number 20).

Figure 11:
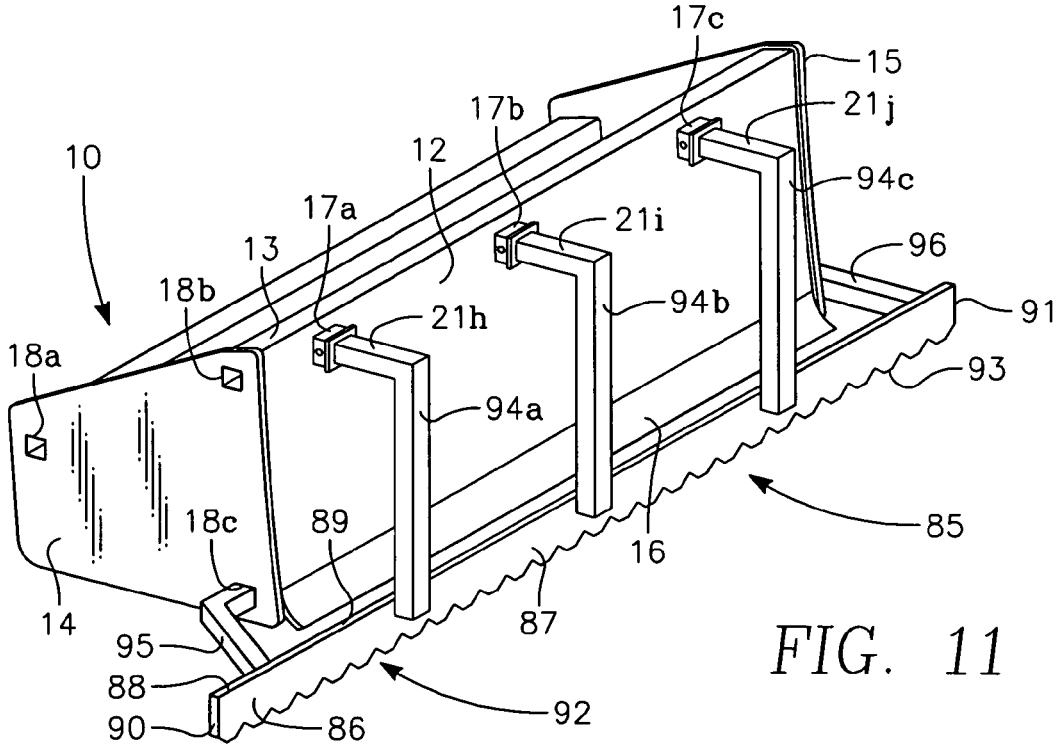
FIG. 11 is an isometric view of the box scraper with the serrated cutting blade work implement attached thereto.

FIG. 11 illustrates the serrated cutting blade work implement 85 as it attaches to the rearward portion 12 of the box scraper 10. There is a main body portion 86 that is substantially planar having a front face 87, a back face 88, a top portion 89 a first side portion 90, a second side portion 91 and a bottom portion 92. The bottom portion is serrated, marked by a series of teeth 93. There is a plurality of attachment means 94*a*, 94*b*, 94*c* attached to the front face 87 of the main body portion 86 that attach perpendicularly to a plurality of male attachment means 21*h*, 21*i*, 21*j* that secure the cutting blade 85 to the first plurality of attachment means 17*a*, 17*b*, 17*c* located on the rearward portion 12 of the box scraper 10.

A first side attachment means 95 attaches to the first side 14 of the box scraper 10. The first side attachment means 95 is attached to the back face 88 of the serrated cutting blade 85 and bends a right angle to fit into one of the female attachment means 18*c* located on the first side 14 of the box scraper 10. A second side attachment means 96 attaches in an analogous manner to the second side 15 of the box scraper 10.

Figure 12A:
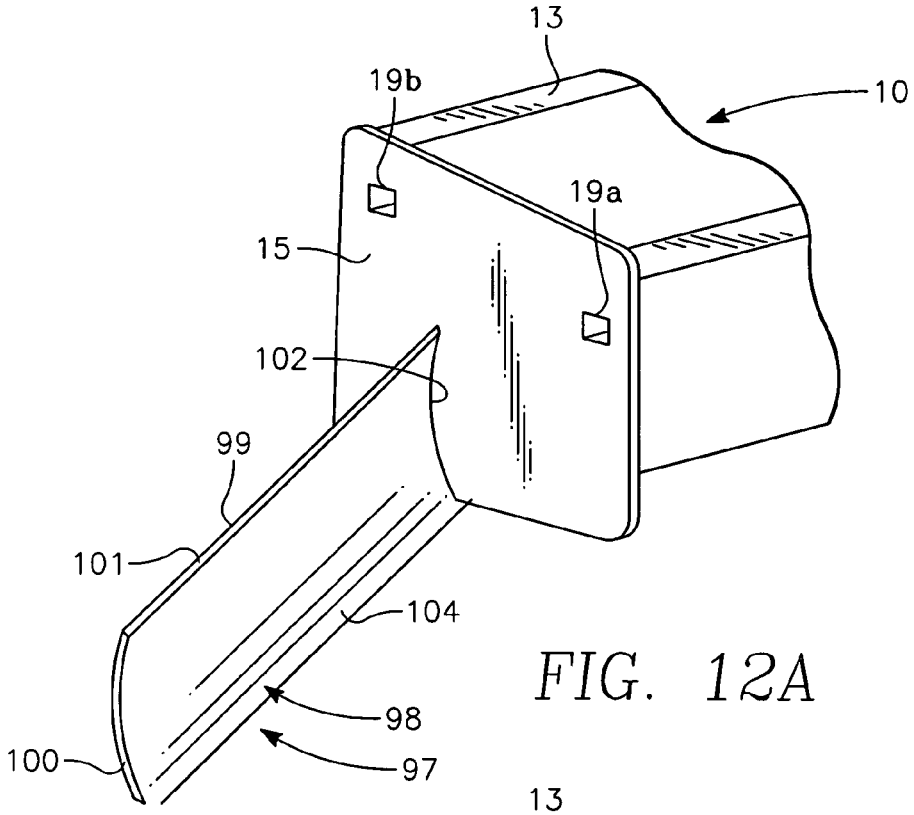
FIGS. 12A and 12B are isometric views of the box scraper with the gutter blade work implement attached thereto from the front and from the rear, respectively.
Figure 12B:
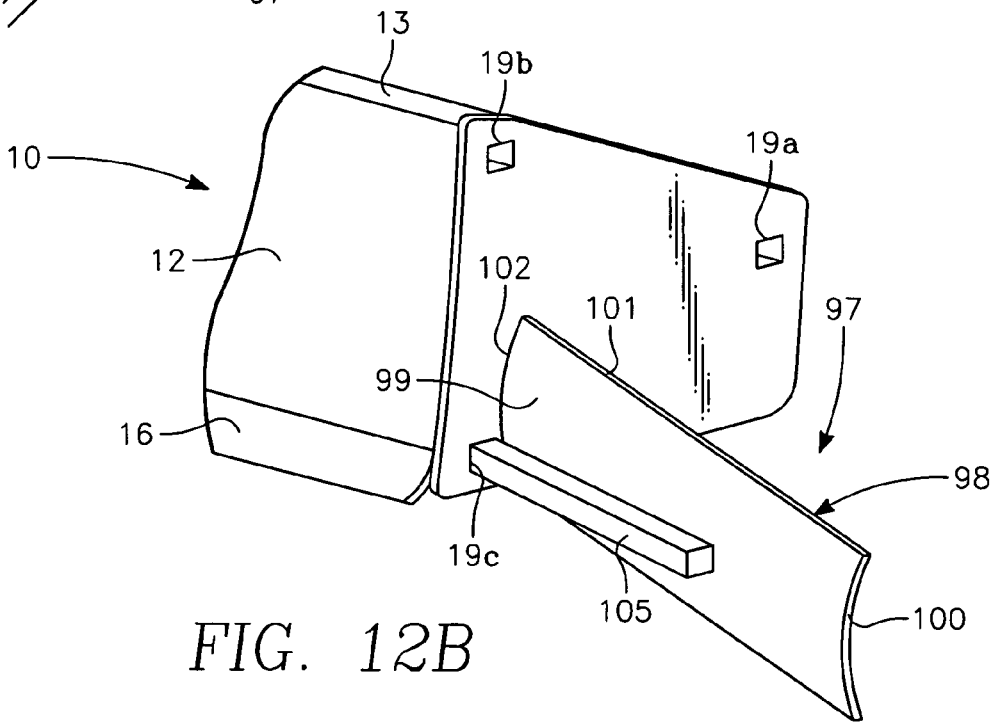

FIGS. 12A and 12B illustrate the gutter blade work implement 97 as it attaches to the second side portion 15 of the box scraper 10. The gutter blade 97 has a substantially rectangular shaped main body portion 98 that has a front concave side 99, a back convex side 100, a top edge 101, a connectible side edge 102, an opposing non-connectible side edge 103 and a bottom edge 104. There is a protruding member 105 that is slightly shorter in length than the main body portion 98. The protruding member 105 is positioned substantially in the center portion of the convex side 100 of the gutter blade 97. There are one or more male attachment means attached to the gutter blade 97 on the connectible side edge 102 attaching the gutter blade 97 to either the first side 14 or the second side 15 of the box scraper 10.

The illustrations and examples provided herein are for explanatory purposes and are not intended to limit the scope of the appended claims. This disclosure is to be considered an exemplification of the principles of the invention and is not intended to limit the spirit and scope of the invention and/or claims of the embodiment illustrated. Those skilled in the art will make modifications to the invention for particular applications of the invention.

What is claimed is:

1. A method for providing for improved functionality and flexibility of a tractor, comprising:

attachment of a box scraper on the back of said tractor through connection of said box scraper to a hydraulic system found on said tractor that allows for vertical movement of said box scraper, said box scraper further comprising:

a main frame having a rearward end;

a first side;

and a second side; and a row of three or more female fittings wherein said row of female fittings is positioned on said rearward end of said main frame in a linear horizontal orientation;

releasable attachment of a modified work implement to one or more of said female fittings wherein said modified work implement is further defined as a trench compaction wheel, said trench compaction wheel further comprising a first elongated member positioned in a substantially vertical position;

an axle portion attached to said first elongated member;

male attachment means connected to said first elongated member, said male attachment means being positioned substantially perpendicular thereto;

one or more substantially circular members, said circular members containing a plurality of teeth that turn in a circular direction when pressure is exerted on said axle portion, said axle portion being positioned between said circular members and said first elongated member, said axle portion releasably attaching to one of said female fittings on said rearward end of said main frame.

2. An apparatus for providing for improved functionality and flexibility of a tractor, comprising a box scraper attached to the back of said tractor through connection of said box scraper to a hydraulic system found on said tractor that allows for vertical movement of said box scraper, said box scraper further comprising a main frame having a rearward end;

a first side;

and a second side; and a row of three or more female fittings wherein said row of female fittings is positioned on said rearward end of said main frame in a linear horizontal orientation wherein said modified work implement is further defined as a trench compaction wheel, said trench compaction wheel further comprising a first elongated member positioned in a substantially vertical position;

an axle portion attached to said first elongated member;

male attachment means connected to said first elongated member, said male attachment means being positioned substantially perpendicular thereto;

one or more substantially circular members, said circular members containing a plurality of teeth that turn in a circular direction when pressure is exerted on said axle portion, said axle portion being positioned between said circular members and said first elongated member, said axle portion releasably attaching to one of said female fittings on said rearward end of said main frame.

* * * * *